US005574421A

United States Patent [19]

Hickling

[11] Patent Number: 5,574,421

[45] Date of Patent: Nov. 12, 1996

[54] SNAP DISC THERMOSTAT AND SELF CALIBRATING ASSEMBLY METHOD

[75] Inventor: Colin D. Hickling, Frankfort, Ky.

[73] Assignee: Trig, Inc., Frankfort, Ky.

[21] Appl. No.: 307,984

[22] Filed: Sep. 14, 1994

[51] Int. Cl.[6] ..... H01H 37/74; H01H 37/12; H01H 37/54; H01H 11/00

[52] U.S. Cl. ..... 337/343; 337/347; 337/360; 337/365; 337/368; 337/381; 29/622

[58] Field of Search ..... 337/318, 319, 337/347, 360, 368, 380, 381, 374, 375, 360, 343, 357, 365, 372, 315; 29/623, 622

[56] References Cited

U.S. PATENT DOCUMENTS

| | | | |
|---|---|---|---|
| 2,256,007 | 9/1941 | Andresen . | |
| 2,724,961 | 11/1955 | Logue . | |
| 3,609,622 | 9/1971 | Pringle | 337/354 |
| 3,636,622 | 1/1972 | Schmitt . | |
| 3,861,032 | 1/1975 | Schmitt | 29/623 |
| 4,048,611 | 9/1977 | Kuczynski et al. . | |
| 4,495,481 | 1/1985 | Hickling et al. . | |
| 4,669,182 | 6/1987 | Ferroni | 29/622 |
| 4,682,141 | 7/1987 | Hickling . | |
| 4,689,599 | 8/1987 | Calenda et al. . | |
| 4,696,579 | 9/1987 | De Filippis et al. . | |
| 4,754,251 | 6/1988 | Ting | 337/107 |
| 4,952,901 | 8/1990 | Chrupcala | 337/372 |
| 5,048,974 | 9/1991 | Dupuy . | |
| 5,296,834 | 3/1994 | Urban | 337/372 |

*Primary Examiner*—Leo P. Picard
*Assistant Examiner*—Stephen T. Ryan
*Attorney, Agent, or Firm*—King and Schickli

[57] ABSTRACT

A thermostat includes a case assembly with two terminals and movable contacts, one of which is on a resilient blade to open and close a circuit through the terminals. A bimetal disc actuates the blade by heating to open the contacts. A base defines an interface with the case assembly and supports the disc; the interface being deformed or crushed sufficiently to position the blade to define the threshold temperature and to couple the base and case assembly together. The deformable interface is preferably formed by upstanding, curved projections on the base and mating with the case assembly. When deformed, the projections are substantially perpendicular to the bottom panel of the base so that the disc is centered, but is freely movable. Bendable legs secure a cap in position and lock the case assembly and the base together. In the assembly method, the case assembly and base with the bimetal disc in position are heated to a controlled threshold temperature causing the disc to be bowed prior to pressing the case assembly into the base to deform the interface. The cap is secured locking the case assembly and base together. Additional calibration may be provided by extending the pressing step after the threshold temperature is reached.

10 Claims, 3 Drawing Sheets

25
25

37
20
21
18
19
13
11
15
30
HEAT 14
13
11
11a
37
17
21
20
18
19
25
15
12
11a
11
25

SNAP DISC THERMOSTAT AND SELF CALIBRATING ASSEMBLY METHOD

BACKGROUND OF THE INVENTION

The present invention relates to thermostat having a bimetal temperature sensing member and related manufacturing method, and more particularly to such a thermostat having design features providing self calibration to define the predetermined threshold temperature of the thermostat.

The provision of an accurately calibrated thermostat is a prime concern to many product manufacturers today. Home appliances, such as coffee makers, tea kettles, corn poppers, hair dryers and the like must be carefully temperature controlled to provide an even temperature and to prevent overheating. Likewise, other consumer products from computers to automobiles utilize a large number of thermostats for the same or similar purposes.

There are two basic types of thermostats that are widely commercialized for these and related purposes; namely, a creep thermostat characterized by components that move continuously, and a snap thermostat where the components move suddenly or discontinuously. The snap thermostat category is divided into two basic types, one with a blade type bimetal member and the other with a disc type bimetal member. Because of the competitiveness of thermostat manufacturers, the design of thermostats and the related manufacturing processes are today highly sophisticated in a technical sense. Of all of the requirements with regard to the technical development of thermostats, the overriding consideration is quality and safety of the final product. Of course, each manufacturer is also concerned with holding the cost to manufacture down commensurate with the degree of quality and safety that is required.

In the past, some designs of thermostats have fallen short of these goals. This is particularly true with regard to thermostats that have substituted a thin walled glass reinforced plastic body for ceramic construction. In these devices, the thin wall is prone to cracking and can result in failure or an electrical shock hazard. Other thermostats are of a design that require a manufacturing process that tends to result in damage or loosening to the delicate electrical contacts and terminals. Other thermostats utilizing caps that are spin rolled or staked to the thermostat body can cause cracking of the structure, and in extreme cases this can cause generation of sufficient internal dust in the thermostat to cause a coating of the contacts and interruption of the proper thermostat operation. In some cases, there have been ill-advised attempts to maintain the cap as thin as possible which simply compounds these difficulties. Also, some extreme spin rolling and staking manufacturing techniques in the past tend to cause distortion of critical components within the thermostat. This in turn inherently causes a change in the critical internal dimensions, including the spacing between the contacts, further interfering with the proper operation.

Further with regard to the manufacturing processes of the thermostat, some have required a high degree of precision of manufacturing to provide an acceptable level of calibration. An example of this is the accepted tolerance for an actuating shaft between the bimetal member and the resilient blade supporting the movable contact. One prior thermostat requires a close tolerance of plus or minus two ten thousandths inch (±0.0002 inch). Because of the close tolerance situation in these prior thermostats, manufacturers have resorted to such time consuming additional steps of selection and matching of components in order to obtain the proper calibration.

A typical example of a prior art snap thermostat is illustrated in the Schmitt U.S. Pat. No. 3,636,622. As can be seen by analysis of the thermostat illustrated in the '622 patent, some of the shortcomings of the prior art are inherent in its design. Furthermore, the manufacturing process is complicated in that the parts are combined so as to use simple friction for retention during assembly. Because the use of simple friction in this manner requires highly accurate and expensive components, the calibration of the thermostat in this manner is undesirable. Furthermore, the design of the thermostat and the manufacturing process is such that compensation must be introduced for varying ambient temperature and other parameters. Final retention of the parts is attempted by the use of adhesive, which is not only inherently unreliable, but costly. It is also inherently messy in its application.

In view of these combined design and manufacturing shortcomings, the present invention is characterized by a thermostat comprising novel components combined to optimize the integrity and accuracy of the finished thermostat. A part of the invention is also directed to the manufacturing method that is simplified from the methods of the past, and at the same time results in improvements to the calibration of the thermostat. The method is characterized by a self calibrating step during the assembly and without the need for compensation.

SUMMARY OF THE INVENTION

Accordingly, it is a primary object of the present invention to provide an improved thermostat, and related manufacturing method, having component parts and specific method steps that are designed to overcome the prior shortcomings in this art, as identified above.

Another object of the present invention is to provide a thermostat wherein the component parts are free of troublesome thin sections and by design are stress free to enhance the integrity and quality of the thermostat.

It is another related object of the present invention to provide a thermostat that by design does not require inefficient manufacturing steps such as staking or spin rolling, and which inherently prevents dusting within the thermostat that tends to cause erratic operation.

It is another object of the present invention to provide a thermostat that is rugged in design, but which utilizes simple components and simple method steps for assembly.

Still another object of the present invention is to provide a thermostat wherein the components need not be fabricated to close tolerances, but where highly accurate calibration is obtainable by a simple deforming step along an interface of the base during assembly.

Another and related object of the invention is to allow easy adjustment of the spatial relationship of key components during assembly, including the case assembly and the base, which in turn provides accurate calibration in a highly reliable manner.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention, an improved thermostat for energizing an electrical circuit, such as in an electrical home appliance, comprises a case assembly having first and second electrical terminals, a resilient blade having a first contact on the first terminal and a second contact on the second terminal that is opposed to the first contact. The contacts serve to open and close the circuit in response to relative movement. A bimetal member, such as a bimetal disc, is positioned in the thermostat to actuate the blade by heating and thereby cause the relative movement of the contacts. This, of course, defines the predetermined threshold temperature.

A base engages the case assembly and defines an interface that advantageously is deformed sufficiently to couple said base and said case assembly together in a highly efficient manner. The deformation adjusts the spatial relationship of these parts and thus controls the position of the blade as it is moved in response to its engagement with the bimetal member. The bimetal member is supported in the base and the engagement with the blade is through an actuating rod. The bimetal member takes the form of a snap disk, and the actuating rod engages it in the center and extends substantially through the center of the case assembly to its point of contact with the blade.

In accordance with an important aspect of the present invention, the deformable interface allows for accurate adjustment of the position of the components without any complicating compensations. The preferred embodiment of the interface is made up simply of a plurality of deformable projections extending upwardly from the base and mating with the case assembly. For symmetry, the projections are substantially equally spaced around the perimeter of the base. In order to assure free movement of the bimetal disc seated on the bottom panel of the base, the projections are preformed to be substantially curved in cross section along the inside edge above the panel. After deformation, the inside edge is substantially perpendicular to the panel, thus assuring that contact with the disc is avoided.

According to another feature of the invention, a pair of upstanding legs on the base serves to align the case assembly and the cap. The legs are sufficiently deformable to be easily bent or folded over onto the cap for securing it in place and locking the case assembly and the base together. Preferably, the base is integrally formed of stamped aluminum and the body of the case assembly and the cap are ceramic. These components, and the manner in which they are combined, provide a highly rugged thermostat that is not prone to cracking or other common causes of failure that have been prevalent in the past.

In the preferred method of assembly of the present invention, the bimetal member or disc is first placed in the base. The case assembly with the actuating rod in place is positioned on the base over the member with the contacts closed. Next, this subassembly is heated in a substantially closed space to a controlled threshold temperature to cause the member to be bowed and snap to its actuated state. When the actuated state of the member is reached, the case assembly is pressed into the base with sufficient force to deform the interface of the base. The pressing step is sufficient to cause a crushing action of the projections and continued until the contacts are opened. The base and case assembly are inherently coupled together and retained by the deformed interface.

In accordance with another step of the preferred method, the pressing step is continued by a predetermined amount beyond the point of coupling of the base and case assembly and opening of the contacts. This is a step required to provide additional calibration where needed for specific thermostat requirements, such as a required temperature differential or delta value, to meet the end product specifications.

Also, the method includes preforming the base to provide the interface so as to be of the desired preferred shape. During the pressing step, sufficient force is generated to retain the case assembly in the base without the fear of slippage, as has been a problem in the past. Also, the pressing step is performed with sufficient force to cause crushing of the interface and in this manner to further enhance the retention step. Finally, the cap is placed on the case assembly during retention and the upstanding legs of the base are bent over to provide locking of the components together.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawing incorporated in and forming a part of the specification, illustrates several aspects of the present invention and together with the description serves to explain the principles of the invention. In the drawing.

Reference will now be made in detail to the present preferred embodiment of the invention, an example of which is illustrated in the accompanying drawings.

DETAILED DESCRIPTION OF THE PREFERRED EMBODIMENT

Figure 1:
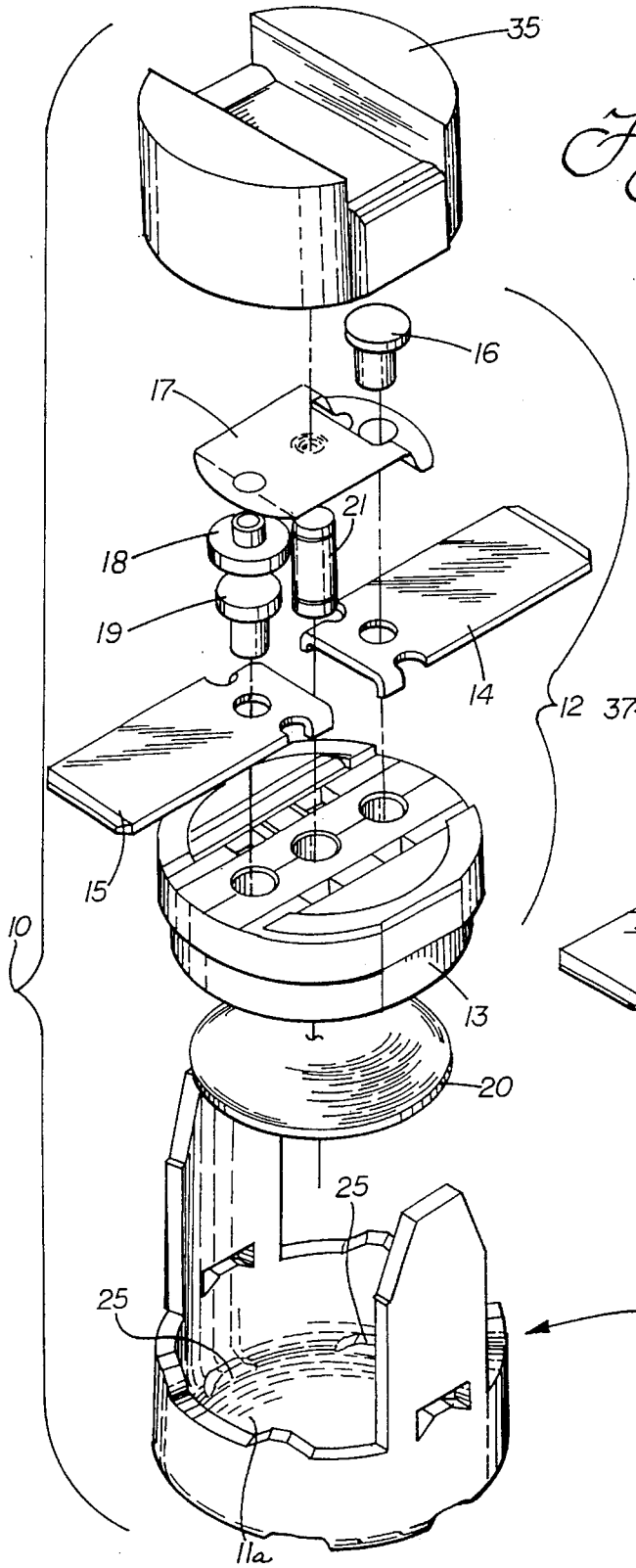
FIG. 1 is an overall perspective view illustrating the components of the thermostat of the present invention in exploded relationship.

Reference is now made to FIG. 1 of the drawings showing an improved thermostat with the components being bracketed and generally represented by the reference numeral 10. As will be apparent to those of ordinary skill in the art, the thermostat 10 is for the purpose of energizing an electrical circuit in response to the sensing of a particular temperature. The thermostat 10 finds its widest application in closing and opening a circuit for a heating element, electric motor or the like in an appliance or similar consumer product. In the broadest application of the invention, it will be recognized that the preferred environment of the invention, including the related method of assembly, relates to snap disk thermostats; however, it is to be understood that other types of thermostats including a bimetal blade type snap thermostat, as well as a creep thermostat, can use the broadest features of the inventive thermostat 10 and its method.

The overall relationship of the components of the thermostat 10 is best shown in FIG. 1. A base 11 is provided to receive a case assembly, generally designated by the bracket reference numeral 12, which includes a case or body 13 and a pair of electrical, blade type terminals 14, 15. The first terminal 14 is connected to the case 13 by a rivet 16, which in turn also mounts a resilient blade 17 having a first contact 18 mounted on the opposite end. The second terminal 15 is connected to the case 13 by a combined rivet/contact 19.

The second contact 19 is directly opposed to the first contact 18 and in response to relative movement, caused in this case by movement of the resilient blade 17, these contacts 18, 19 can close and open to complete and interrupt an operating circuit (not shown). A bimetal member, which in the preferred embodiment takes the form of a bimetal disc 20, is designed to snap into a generally bowed state in response to heating to a predetermined threshold temperature. The individual characteristics of the disc 20 may vary slightly due to variations in the metals, as well as from variations in its manufacturing process.

Figures 2, 2A, 2B:
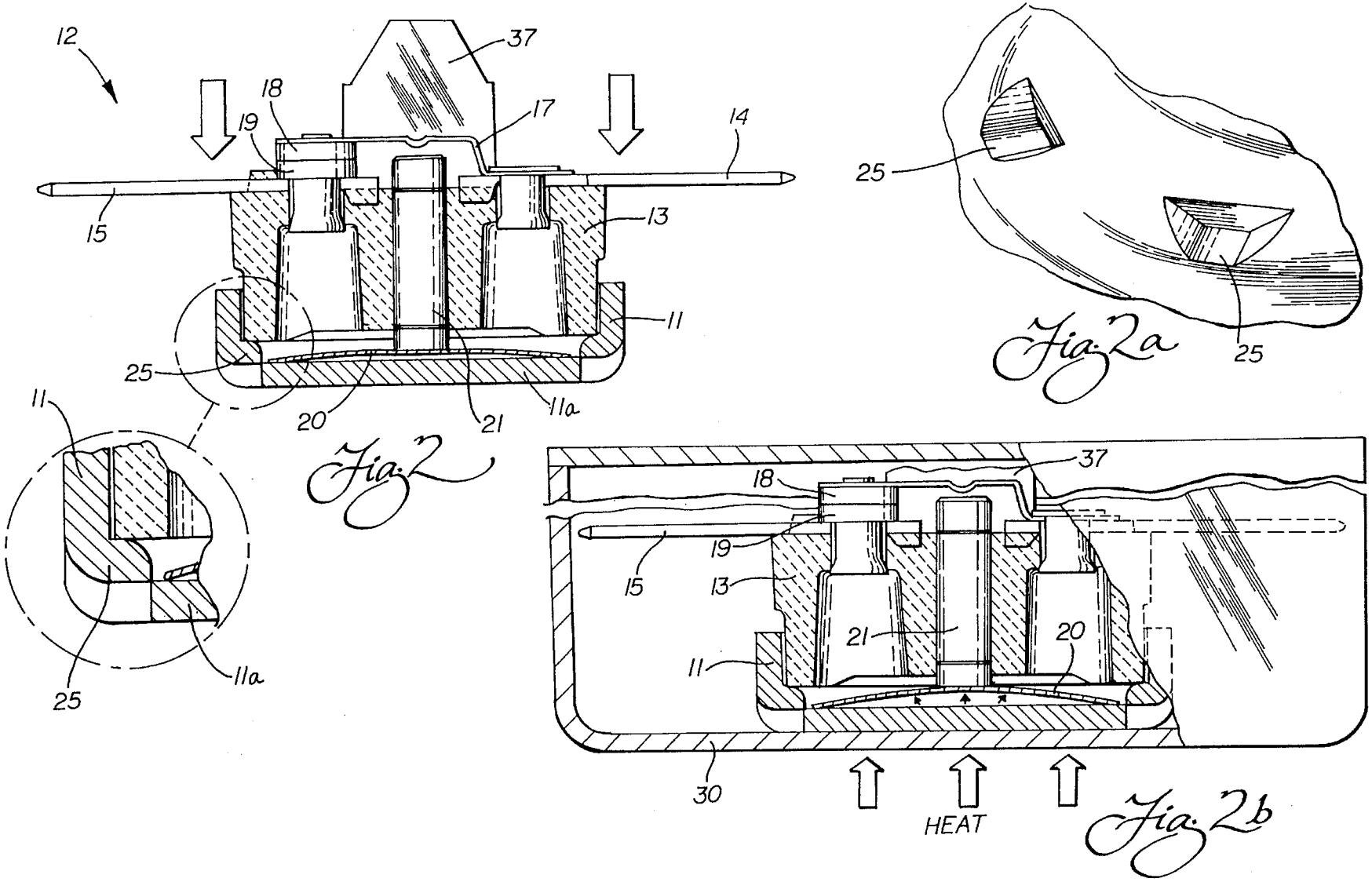
FIG. 2 is a cross sectional view taken through the center of the thermostat limited to the case assembly positioned in the base, and including an enlarged inset detail of one projection that defines the deformable interface.
FIG. 2*a* is a cutaway partial view of the underside of the bottom panel of the base showing the opposite side of two adjacent deformable projections.
FIG. 2*b* is a cross section view of an enclosure for heating of the case assembly and base prior to deformation of the projections.
Figure 3:
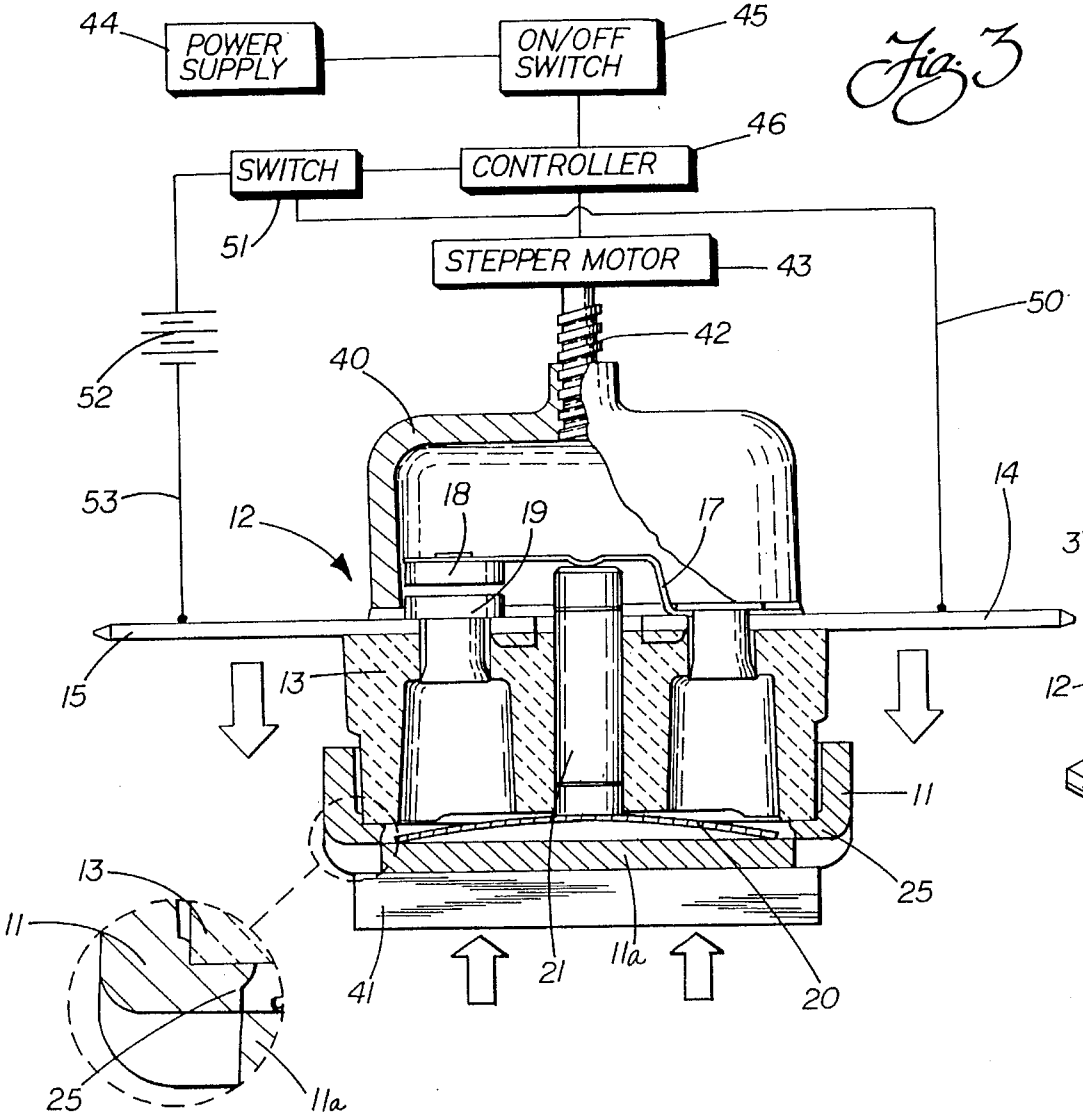
FIG. 3 is a cross sectional view of the case assembly and base similar to FIG. 2 but showing the application of the pressing force to deform the projections, and including an enlarged inset detail of the interface after deforming.

The disc 20 serves to actuate the blade 17 through reciprocating movement of an actuating rod 21 (see also FIGS. 2 and 3). The rod 21, which is also known in the industry as a pill because of its shape, extends through and slides in a mating aperture in the center of the case 13. As can be seen by comparing FIGS. 2 and 3, as the bimetal disc 20 is heated and is bowed into the high temperature position, the actuating rod 21 moves with the disc 20 in order to raise the resilient blade 17, and thus open the contacts 18, 19. The predetermined threshold temperature where this occurs will be explained further in detail below in the description of the method portion of the present invention.

The base 11 includes a plurality of deformable projections 25 around the perimeter. These projections in effect form an interrupted ring. As the case or body 13 is pressed into the ring of projections 25, an interface is defined. The interface is deformed sufficiently to ultimately establish the spatial relationship of the contacts 18, 19 that is critical for calibration (see FIG. 3, including the enlarged insert).

Advantageously, the calibration of the thermostat is adjusted by controlling the amount of deformation of the interface of the projections 25. As the pressing force is applied, the deformation into the projections 25 is governed by the opening of the contacts 18, 19 as described above, and as will be described more in detail below during the discussion of the method aspects of the present invention.

Prior to pressing the case assembly 12 into the base 11, it is preferable to heat this subassembly in an enclosed container, such as container 30, illustrated in FIG. 2*b*. The heat is applied by immersing the subassembly in a heated fluid, and holding or soaking it for sufficient time to make certain that the bimetal disc 20 is bowed to the upward or actuated state position.

As can best be understood by viewing FIGS. 1 and 2 together, the projections 25 are preferably equally positioned around the perimeter of the bottom panel 11*a*, to form the ring. This in turn defines the inside perimeter of the base 11. The projections 25 are substantially curved in cross section along the inside edge above the panel 11*a* prior to deformation, as best shown in the enlarged insert in FIG. 2. This feature is important in that upon deformation, the curved cross section along the inside edge results in the edge being transformed into the interrupted ring with an inside edge that is substantially perpendicular to the panel 11*a* (see the insert of FIG. 3). This feature is important since it provides for the bimetal disc 20 to be positioned in the base 11 and centered while retaining its ability for free snap movement during temperature transitions. This assures that the thermostat 10 of the present invention is operable so as not to be erratic due to interference around the edge.

Figure 5:
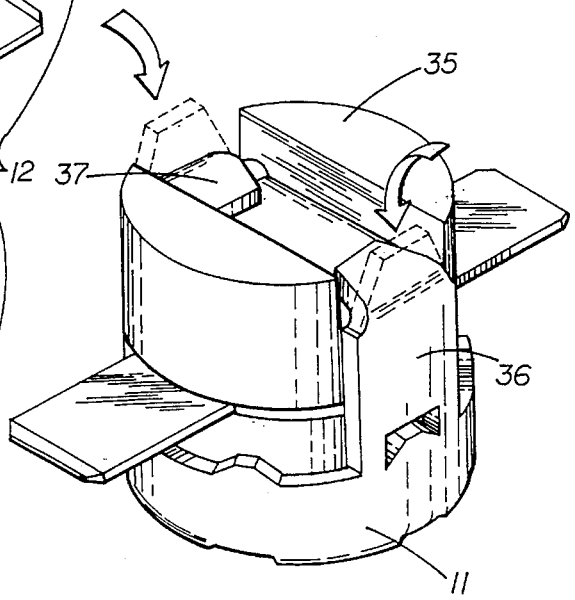
FIG. 5 is an illustration of the completed thermostat and showing the bending or folding of the upper portion of the legs to secure the cap and lock the case assembly and base together.
Figure 4:
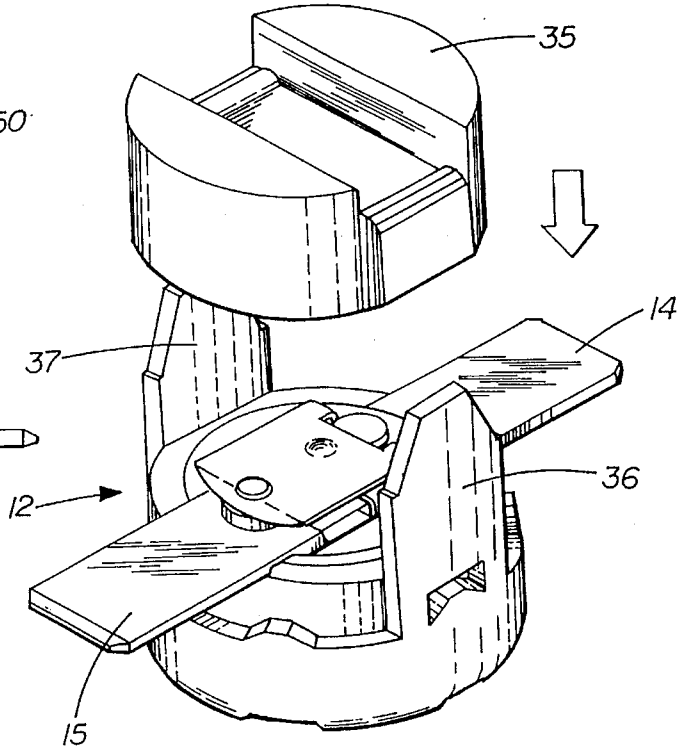
FIG. 4 is an illustration of the assembled case assembly and base with the cap ready to be applied.

As best illustrated in FIGS. 4 and 5 of the drawings, the thermostat 10 is completed by a cap 35 that sets on top of the case assembly 12. The sides of the case assembly 12 and the cap 35 are flattened so as to be received by a pair of upstanding legs 36, 37. Because of these mating surfaces, the components can be quickly and accurately assembled. Once the cap 35 is in position, the upper portion of the legs 36, 37 are bent or folded over onto the cap 35 and this final operation serves to lock the case assembly 12 and the base 11 together, as desired.

In the preferred embodiment, the base 11 is stamp formed of aluminum, and is in the order of 0.040 inch in uniform thickness. The case or body 13 of the case assembly 12 is molded of ceramic, as is the cap 35 thus providing electrical insulation of the terminals 14, 15 and the contacts 18, 19 that are encapsulated.

From the foregoing description of the thermostat 11, it will be realized that the objectives have been fully met. The thermostat 10 is particularly rugged in design so that it is not prone to failure as are prior art thermostats. At the same time, the design is characterized by being simple with a minimum number of components that are easily assembled. Foremost is the concept of providing self calibration by pressing the case assembly 12 into the projections 25 so as to couple the components together and to automatically define the operating components positioning at which the disc 20 snaps to its actuated state and the contacts 18, 19 are opened. The curved design of the inside edge of the ring defined by the projections 25 assures that the bimetal disc 20 is properly centered, but that it remains free of interference during operation.

With reference now to FIGS. 2 and 3 of the drawings, more detail of the method of assembly of the thermostat 10 of the present invention can be described. With the bimetal disc 20 in position on bottom panel 11*a* of the base 11, the case assembly 12, including the actuating rod 21, is placed within the base 11. The lower edge of the case or body 13 is resting on the top of the spaced projections 25 that form the interrupted support ring (see in particular FIG. 2). In this step, the contacts 18, 19 are closed.

This subcombination of the case assembly 12 and the base 11 are placed in an enclosure, such as the container 30, wherein heat is applied to the immersing fluid in the container, as best shown in FIG. 2*b*. As indicated above, the heat is raised to a controlled threshold temperature in order to cause the bimetal disc 20 to bow and snap upwardly, which in turn lifts the actuating shaft 21. As will be recognized, the bowing of the disc 20 is exaggerated in this figure for illustrative purposes. In a typical thermostat 10 with a one-half inch bimetal disc 20, the snap range or delta movement is approximately 0.006 inch.

The next step is best illustrated in FIG. 3 where the case assembly 12 is being shown as being pressed into the base 11 to deform the interface of the projections 25 in the required amount. As illustrated, one arrangement for generating the approximately 600 pounds pressing force to carry out this operation is provided by a substantially circular mandrel 40 designed to press against the upper rim of the case assembly 12 when it is positioned on a suitable jig 41. The cup-shaped mandrel 40 has a central threaded opening to receive a jack screw 42 which is turned by a suitable motor, such as an electric stepper motor 43. A power supply 44 operating through an on/off switch 45 operates a computerized controller 46 for the stepper motor 43.

In order to provide a signal directly to the controller 46 in response to the opening of the contacts 18, 19, the first terminal 14 is connected by a lead 50 through a switch 51. A power source 52 connected through lead 53 to the second terminal 15 completes the circuit. Thus, during this assembly step, the operator is required only to actuate the on/off switch 45 and in response to this the controller 46 powers the stepper motor 43 to press the case assembly 12 to the required position in the base 11 as the projections 25 are deformed. Once the contacts 18, 19 open, the switch 51 signals the controller 46 that the pressing step should be terminated since the simulated required operating temperature of the bimetal disc 20 for opening the contacts 18, 19 is reached.

Advantageously, this deformation at approximately 600 pounds force is sufficient to cause a crushing action of the projections 25 and in turn this causes the body 13 to be firmly coupled with the base 11, and thus accurately retained.

Another feature of the invention may be built into the computerized controller 46 wherein the pressing step is continued beyond the point when the contacts 18, 19 are opened. This additional pressing results in biasing the thermostat to an extended open position and is useful to adjust a particular thermostat. In practice, the additional pressing can be regulated by a delay circuit in the controller 46, or by software. A movement of an additional 0.002 inch to about 0.006 inch for a typical snap disc thermostat with a one-half inch disc is typical. The stepper motor 43 is capable of the precise control of the cut-off point required for this procedure.

In practice, the heat applied in the step illustrated in FIG. 2*b* is controlled to match the threshold temperature of the thermostat 10. However, it will be realized that in a snap thermostat of the type described, additional heating can be tolerated so long as the bimetal disc 20, or similar bimetal member used, does not provide additional bowing after the snap to the actuated state. The key is that there be no variation in the spacing of the contacts 18, 19 after snapping open during the step illustrated in FIG. 3, except as designed for controlling.

It will be realized that it is particularly advantageous in accordance with the method of the present invention that no compensation is required for calibration of the thermostat 10. Once the threshold temperature is reached, no additional adjustment is needed. In other words, the opening of the contacts 18, 19 signifies a known threshold temperature, and the self calibration provided by the cut-off of the operation of the controller 46 to complete the deformation step of FIG. 3 is final.

The deformation/crushing of the projections 25 serves to retain the case assembly 12 and the base 11 in the required adjusted position with the contacts 18, 19 open to the specific, design spacing of the thermostat 10. At this point in the method, the cap 35 is secured in position, as shown in FIGS. 4 and 5, by bending or folding over the top portion of the deformable legs 36, 37. This step assures locking of the base 11 and the case assembly 12 together. Adjustments or measurements of any kind are also not required after this step. The completed thermostat 12 illustrated in FIG. 5 is ready for installation in an appliance for use.

The thermostat 10 of FIG. 5 is stronger than comparable thermostats of the prior art. The strength is gained by the manner in which the case assembly 12, the base 11 are coupled and locked together. The case assembly 12 is nested in the base 11, on the ring of deformed projections 25, and then is locked in place by the cap 35 and folded portions of the legs 36, 37. In effect, the internal working mechanism is ideally isolated and insulated in a protective, cocoon-like structure that prevents cracking and absorbs shock better than prior art arrangements.

There is no distortion of these structural components when the inventive method is used. All components are relatively thick and are not stretched or thinned during the assembly operation. The inherent design of the thermostat 10, and the method used to manufacture it not only provides full electrical insulation by combining the ceramic case assembly 12 and the cap 35, but at the same time it is substantially sealed from ambient conditions. Furthermore, there is no need for any operative or structural component to be machined to close tolerances, or for parts to be matched during assembly, in order to provide the proper and reliable operation.

The manufacturing procedure of the present invention is particularly advantageous since there is no spinning or staking of the components required. As a result, weakening of the components, particularly the ceramic case assembly 12 and the ceramic cap 35 is avoided. Also, the elimination of need for these types of conventional operations assures that internal dusting is eliminated.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with breadth to which they are fairly, legally and equitably entitled.

I claim:

1. A thermostat for energizing an electrical circuit comprising:

a case assembly having first and second terminals;

a resilient blade having a first contact and connected to said first terminal;

a second contact on said second terminal opposed to said first contact to open and close said circuit in response to relative movement;

a bimetal member to actuate said blade by heating to cause said relative movement of the contacts and to define a predetermined threshold temperature; and a base engaging said case assembly defining an interface and for supporting said member, said interface being deformed sufficiently to couple said base and said case assembly together and to position said bimetal member relative to said blade;

whereby the calibration of said thermostat may be provided by adjusting the deformation of said interface.

2. The thermostat of claim 1, wherein said member is a snap disc and is in operative engagement with the blade through an actuating rod extending through said case assembly.

3. The thermostat of claim 2, wherein said rod extends substantially through the center of said case assembly.

4. The thermostat of claim 1, wherein said interface is formed by a plurality of deformable projections upstanding from said base and mating with said case assembly.

5. The thermostat of claim 4, wherein said projections are substantially equally spaced around the perimeter of said base.

6. The thermostat of claim 5, wherein said base includes a bottom panel defining said perimeter, said projections being substantially curved in cross section along the inside edge above said panel where said thermostat is not calibrated and substantially perpendicular to said panel where said thermostat is calibrated.

7. The thermostat of claim 6, wherein said disc is positioned in said base on said panel and freely centered by the inside edge.

8. The thermostat of claim 1, wherein said base includes at least a pair of upstanding legs serving to align said case assembly; and a cap positionable on said case assembly and also aligned by said legs;

said legs being sufficiently deformable to be bent over onto said cap for securing said cap and locking said case assembly and said base together.

9. The thermostat of claim 8, wherein said base is integrally formed of stamped aluminum.

10. The thermostat of claim 9, wherein said case assembly includes a body formed of ceramic and said cap is ceramic to provide electrical insulation of said terminals and said contacts.

* * * * *